US007961561B2

(12) United States Patent
Moeder

(10) Patent No.: US 7,961,561 B2
(45) Date of Patent: Jun. 14, 2011

(54) HANDLESS TIME DISPLAY

(76) Inventor: Daniel Charles Moeder, Sanibel, FL (US)

( * ) Notice: Subject to any disclaimer, the term of this patent is extended or adjusted under 35 U.S.C. 154(b) by 7 days.

(21) Appl. No.: 12/797,191

(22) Filed: Jun. 9, 2010

(65) Prior Publication Data

US 2011/0080811 A1 Apr. 7, 2011

Related U.S. Application Data

(60) Provisional application No. 61/248,651, filed on Oct. 5, 2009.

(51) Int. Cl.
*G04B 19/21* (2006.01)
*G04B 37/00* (2006.01)

(52) U.S. Cl. ..... 368/235; 368/276

(58) Field of Classification Search ..... 368/223–242, 368/276, 316–317
See application file for complete search history.

(56) References Cited

U.S. PATENT DOCUMENTS 218,945 A * 8/1879 Dittmeier ..... 368/222
321,674 A * 7/1885 Bensel ..... 368/78
2,930,183 A * 3/1960 Nussle ..... 368/220
3,635,011 A * 1/1972 Pindell et al. ..... 368/101
3,841,086 A 10/1974 Robin
3,979,898 A 9/1976 Werres
4,022,015 A 5/1977 Bailey
4,044,548 A 8/1977 Rowbottom
4,060,972 A * 12/1977 Kimura et al. ..... 368/73
4,357,691 A 11/1982 Goodchild
4,423,965 A 1/1984 Muller et al.
4,428,682 A * 1/1984 Winter ..... 368/238
4,430,004 A * 2/1984 Nitschke ..... 368/235
5,380,206 A * 1/1995 Asprey ..... 434/257
5,412,625 A * 5/1995 Duchek ..... 368/223
5,581,520 A * 12/1996 Ogden ..... 368/76
5,896,349 A * 4/1999 Haze ..... 368/228
7,196,974 B2 3/2007 Yang et al.

OTHER PUBLICATIONS

Grandfather Clock :: discoverclocks.com/grandfather-clocks.html; Jan. 11, 2011.*

* cited by examiner

*Primary Examiner* — Sean Kayes

(57) ABSTRACT

A clock assembly FIGS. 1.*a*. (1) and 1.*b*. (6), comprising a normal clock mechanism FIG. 2. (10), having numbers one to twelve equidistantly placed around the perimeter of a wheel FIG. 2. (11) in ascending order, that is affixed to the hour spindle of the clock mechanism FIG. 2. (13), and this wheel is visible through a window FIG. 1.*a*. (3) and FIG. 1.*b*. (7) in a case FIGS. 1.*a*. and 1.*b*. holding the clockworks that tells time in a horizontal or vertical manner that architecturally fits in with its rectilinear surroundings.

1 Claim, 3 Drawing Sheets

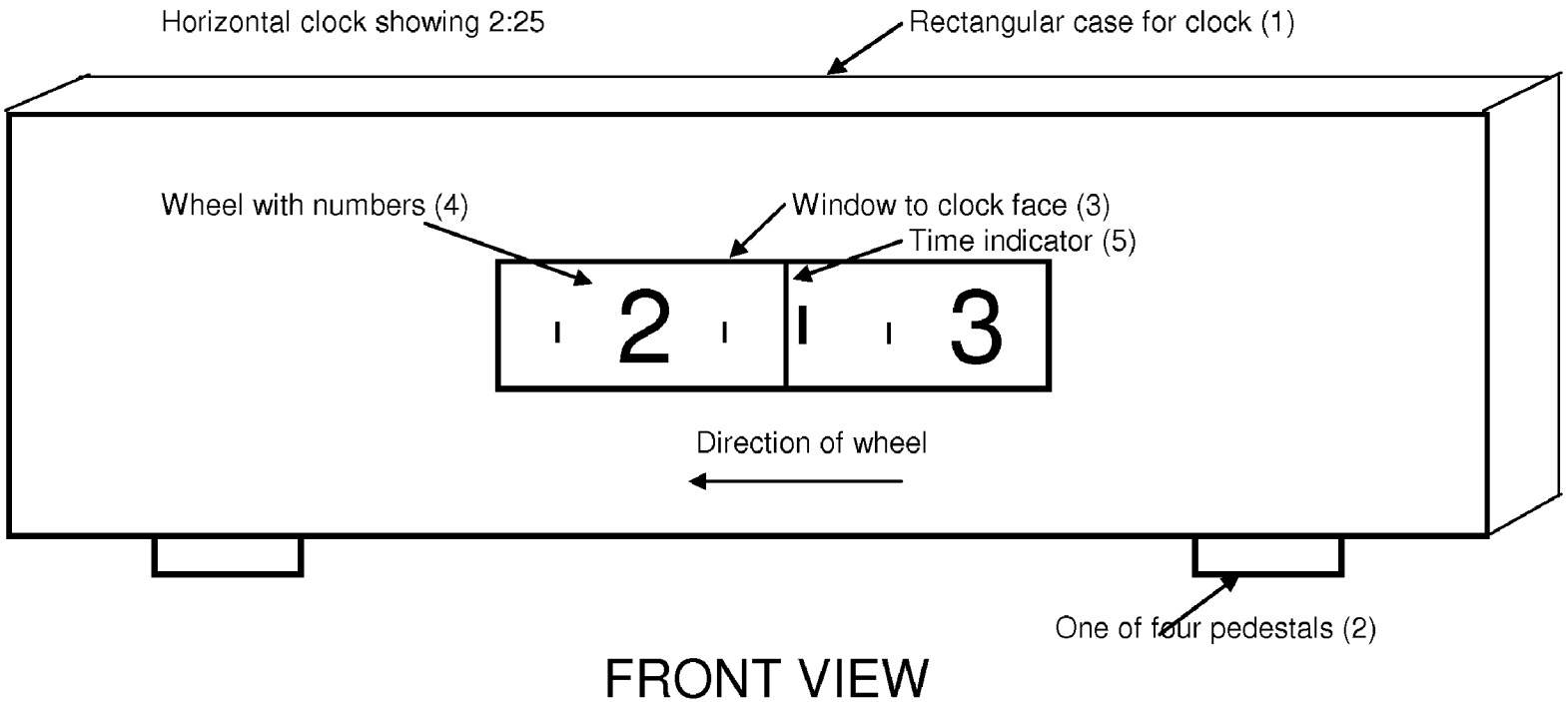
FIG. 1.a.

FIG. 1.b.
Vertical Clock indicating that it is about 3:35
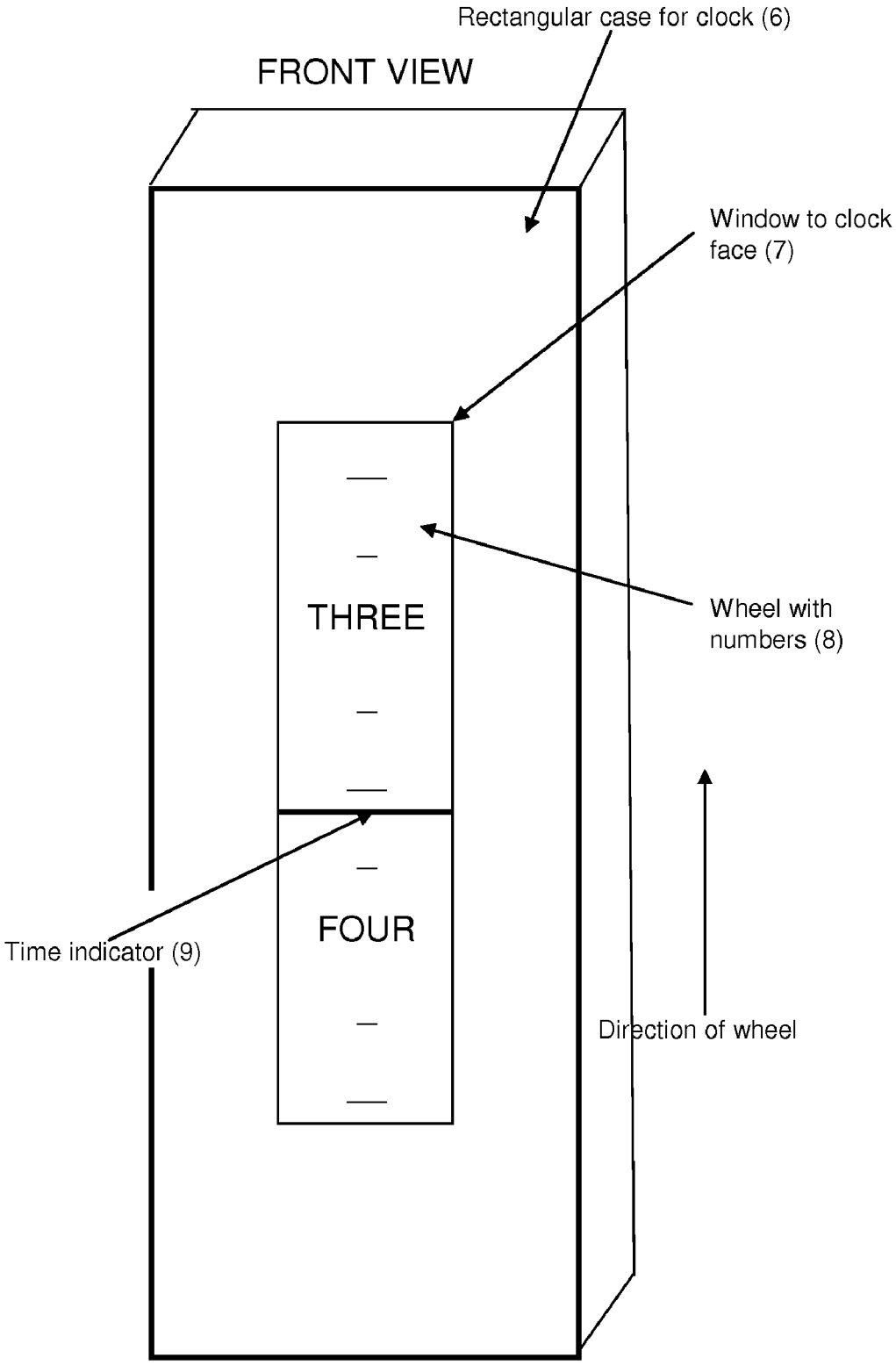

FIG. 2. Clockworks
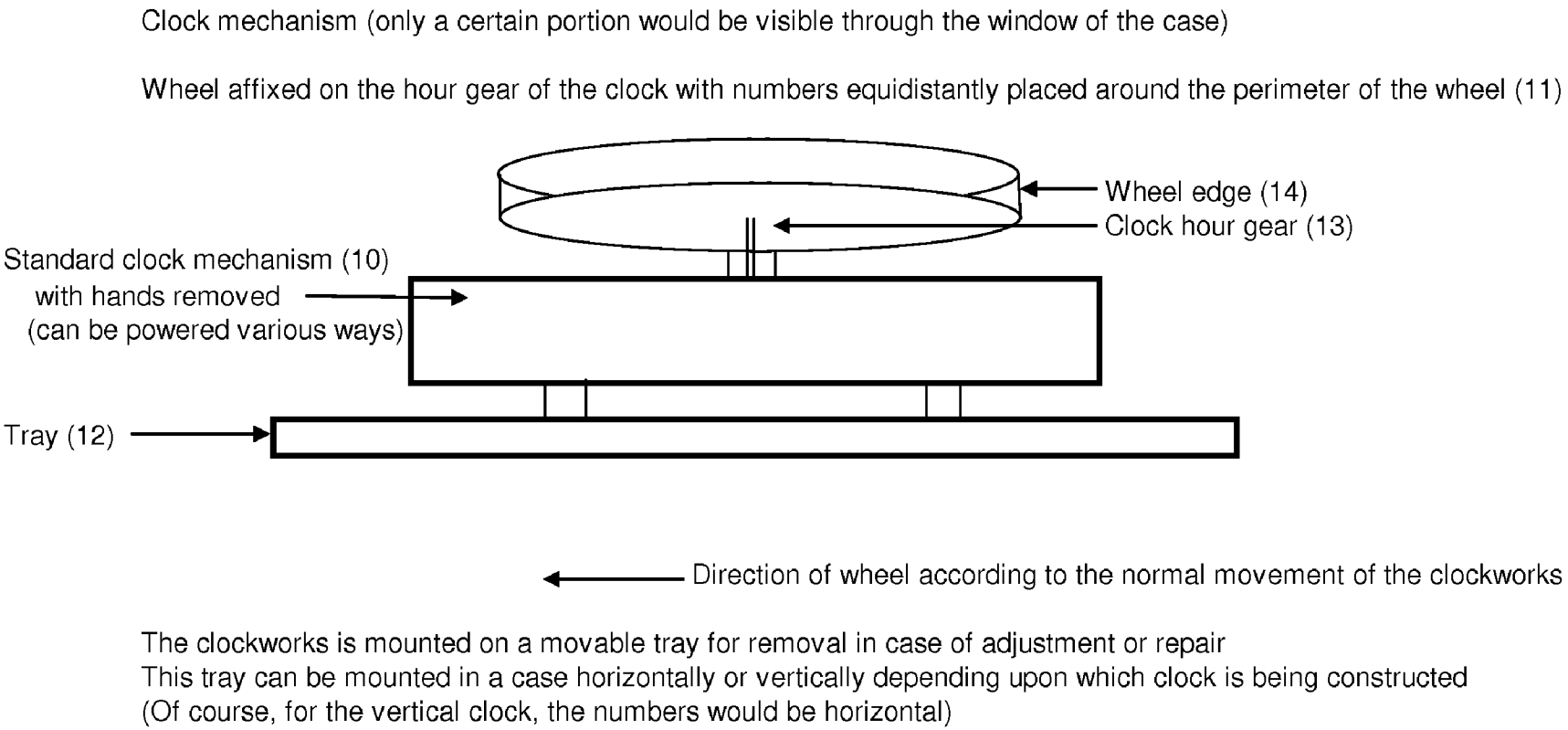

HANDLESS TIME DISPLAY

BACKGROUND OF THE INVENTION

This invention generally relates to clocks but improves upon at least two characteristics of existing clocks;

1) Generally speaking clocks have a round face with the numbers one to twelve, and sometimes with gradients between numbers indicating minutes, indicated on the perimeter of the face, with hands that move 'clock-wise' around the clock to show the hour and sometimes the minute of the day, and 2) Another type of clock, usually box-like in shape, shows only the exact hour and minute in a window on the face of the clock.

With this invention it is possible to determine the hour and the minute of the day as well as see the time that just passed and the time that is approaching, but in a form that is more in context with the surroundings, i.e., the clock can be made in several different rectangular shapes, horizontal or vertical, thereby not disturbing or distracting from the rectilinear background. One example would be a horizontal version of this clock on a mantle, that itself is rectangular, quite possibly with a painting or mirror in the background that is also rectangular. Another example would be a vertical version of this clock placed among books on a bookshelf, which themselves are rectangular. The possibilities are unlimited.

PRIOR INVENTIONS

The clock science includes many types of clocks, too numerous to list. Many of those clocks disclose time as hands move in a 'clock-wise' fashion around a vertical round face that has numbers from one to twelve affixed to the face, and there are other clocks that have a window that show the hour and the minute of the day. Neither of these clocks is in context with the surroundings in which they are usually placed. Therefore, there exists a need in the science for a clock that shows time not in a typical vertical round face manner or just showing the hour and minute, but in a horizontal or vertical rectangular manner.

The clock in this invention utilizes a wheel face secured to a standard clock mechanism to show the hour that just passed, the hour and minute now, and the hour coming up.

SUMMARY OF THE INVENTION

The general objective of this invention is to provide an improved clock and an alternative to existing clocks. Often, due to the round shape of the face of many clocks, they do not fit in with their environment which is rectilinear. This invention is a clock that tells time in an unconventional and unique way that allows it to blend in with the architecture often surrounding it. The housing for the clockworks is a parallelogram shaped container which can be either horizontal or vertical and has a window in one side (the front) so that the time may be observed. The clock face itself is a wheel that has numbers from one to twelve equidistantly vertically placed around its perimeter and this wheel is affixed to the hour movement of the clockworks. Therefore, the horizontal clock allows time (numbers) to be observed by looking through the window as the wheel moves around with the numbers moving from right to left. The vertical clock works similarly, except that instead of numbers, the words one, two, etc. are placed on the wheel in a horizontal fashion, and the words move from bottom to top.

BRIEF DESCRIPTION OF DRAWINGS

The features of this invention, which are novel and unique, are set forth in the claims. The accompanying drawings further describe the invention.

FIG. 1.*a*. shows the front view of the horizontal clock case, or housing, the window into the clock (or face) and the face, or wheel, with the numbers on it. The wheel turns from right to left, the numbers advancing as moved by the clockworks. The back may be opened in order to make repairs or adjustments to the clock. The power for the clockworks could be varied but for a battery operated clock it may be necessary to change the battery or adjust the time, or for an electric clock, to adjust the time in the case of a stoppage.

FIG. 1.*b*. shows the front view of the vertical clock case, or housing, the window into the clock (or face) and the face, or wheel, with the words of the numbers on it. In this version the wheel turns from bottom to top, the words advancing as moved by the clockworks. The power for the clockworks could be varied but for a battery operated clock it may be necessary to change the battery or adjust the time, or for an electric clock, to adjust the time in the case of a stoppage.

FIG. 2. shows the clockworks. It is a standard clockworks, powered by whatever means, usually battery or electricity, with the hands removed. In place of hands a wheel is mounted on the hour mechanism; this becomes the face of the clock which will be visible through the window in the case. The clockworks is mounted on a tray that goes inside the case and is removable so that adjustments to the clockworks can be made as mentioned above.

DETAILED DESCRIPTION OF THE INVENTION

The following description is provided to enable any person skilled in the science to make and use the invention and sets forth the best modes contemplated by the inventor of carrying out the invention. Various modifications will be readily apparent to those skilled in the science since the generic principles of the present invention have been defined herein specifically to provide for an improved, novel and unique clock assembly having a clock mechanism that tells time in a horizontal or vertical manner that architecturally fits in with its rectilinear surroundings as may be seen in FIGS. 1.*a* and 1.*b*.

The preferred embodiment of the clock assembly FIG. 1.*a*. (1) or FIG. 1.*b*. (6) has a clock mechanism FIG. 2. (10) comprised of an internal operating mechanism of any known type, powered by battery or electricity, in a housing, or case.

The separate elements of the case FIG. 1.*a*. (1) or FIG. 1.*b*. (6) may be made in any desired manner in any desired rectangular size (but proportionate to clockworks), in any desired color, window size FIG. 1.*a*. (3) or FIG. 1.*b*. (7) large enough to see the hour that passed, the time now and the hour approaching, with pedestals FIG. 1.*a* (2), time indicator FIG. 1.*a*. (5) or FIG. 1.*b*. (9) distinctive enough for determining the time, a tray FIG. 2. (12) upon which the clockworks is affixed so that it slides into grooved tracks, and the back of the case that opens to access the tray.

The clockworks has the hands removed exposing the hour spindle FIG. 2. (13) upon which the round wheel is affixed. The wheel is proportionate to the clockworks and the clock assembly and has an edge or rim FIG. 2. (14). The edge is wide enough for the placement of numbers (or words in the vertical clock) that may be proportionate to the size of the clockworks and clock assembly. The numbers (or words in the vertical clock), one to twelve, may be of any desired numerical system, font and material that are affixed equidistantly to the edge of the wheel.

The above describes the novel and unique clock assembly that has a clock mechanism that tells time in a horizontal or vertical manner that architecturally fits in with its rectilinear surroundings.

Those skilled in the science will appreciate that various adaptations and modifications of the above described preferred embodiments may be configured without departing from the scope and spirit of the invention. Therefore, it is to be understood that, within the scope of the appended claims, the invention may be practiced other than as specifically described above.

What I claim:

1. A method of forming a handless time mechanism comprising:

providing an analog clock;

said analog clock comprises a time movement, an hour hand, and an hour shaft connecting the movement to the hour hand;

removing the hour hand from the hour shaft;

mounting a disk on the hour shaft;

the disk comprises hour and minute indicia located on a side of the disk such that the hour and minute indicia are visible in a direction perpendicular to an axis of rotation as defined by the hour shaft;

providing a rectangular case, each surface of the rectangular case is either perpendicular or parallel to each other surface of the rectangular case, the rectangular case is opaque except for a single transparent window with a current time marker;

mounting the movement and disk inside the rectangular case, so that a two hour period of time is visible through the transparent window including a previous, current, and next hour.

* * * * *